US010369616B2

(12) United States Patent
Takahashi

(10) Patent No.: US 10,369,616 B2
(45) Date of Patent: Aug. 6, 2019

(54) RING MANUFACTURING METHOD, RING MANUFACTURING APPARATUS, AND RING MANUFACTURED BY THE RING MANUFACTURING METHOD

(71) Applicant: MOKUMEGANEYA Co., LTD., Tokyo (JP)

(72) Inventor: Masaki Takahashi, Tokyo (JP)

(73) Assignee: MOKUMEGANEYA Co., LTD., Tokyo (JP)

( * ) Notice: Subject to any disclaimer, the term of this patent is extended or adjusted under 35 U.S.C. 154(b) by 538 days.

(21) Appl. No.: 15/213,450

(22) Filed: Jul. 19, 2016

(65) Prior Publication Data

US 2018/0021841 A1 Jan. 25, 2018

(51) Int. Cl.

| | |
|---|---|
| ***B21D 53/16*** | (2006.01) |
| ***B21D 11/14*** | (2006.01) |
| ***B21D 28/00*** | (2006.01) |

(52) U.S. Cl.

CPC ..... *B21D 53/16* (2013.01); *B21D 11/14* (2013.01); *B21D 28/00* (2013.01)

(58) Field of Classification Search

CPC ..... B21D 28/00; B21D 28/22; B21D 53/16; B21D 53/44; B21K 1/761; Y10T 29/4959; Y10T 29/49593

USPC ..... 72/338, 339

See application file for complete search history.

(56) References Cited

U.S. PATENT DOCUMENTS 1,477,457 A * 12/1923 Simson ..... B21D 53/44 29/896.412

8,661,682 B2 * 3/2014 Takahashi ..... A44C 9/00 29/896.41

FOREIGN PATENT DOCUMENTS

DE 102006006029 B3 * 6/2007 ..... B21D 53/16

* cited by examiner

*Primary Examiner* — Teresa M Ekiert

(74) *Attorney, Agent, or Firm* — Maier & Maier, PLLC

(57) ABSTRACT

In a case of a "mark left" type, a slit is formed on a line side (slit side) of a joint portion. The slit is formed, for example, with a scroll saw. By the formation of the slit, a length of the joint portion in a direction orthogonal to an axial direction of a single ring is set to approximately 0.7 mm. In a case of a "mark removed" type, a slit and a slit are formed respectively on the line side (slit side) and a side opposite thereto of the joint portion. Those slits are formed, for example, with the scroll saw. By the formation of those slits, the length of the joint portion in the direction orthogonal to the axial direction of the single ring is set to approximately 0.8 mm.

5 Claims, 11 Drawing Sheets

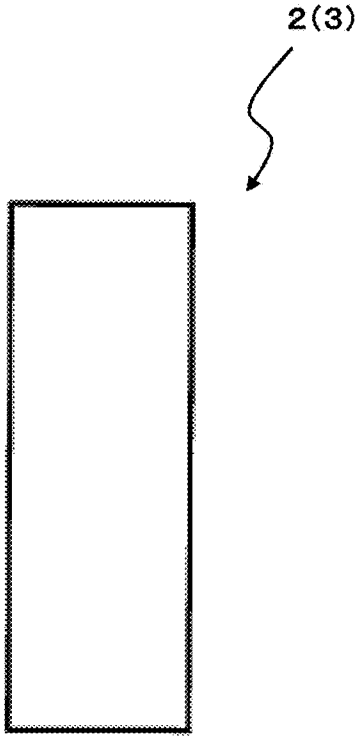
FIG.1B
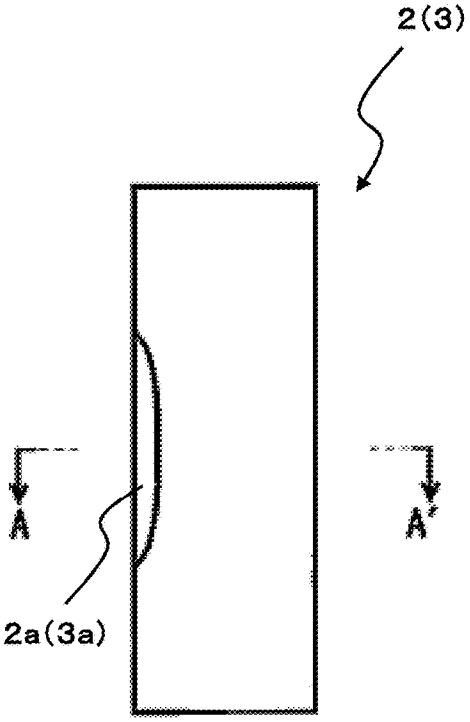
FIG.1A
FIG.1

FIG.2
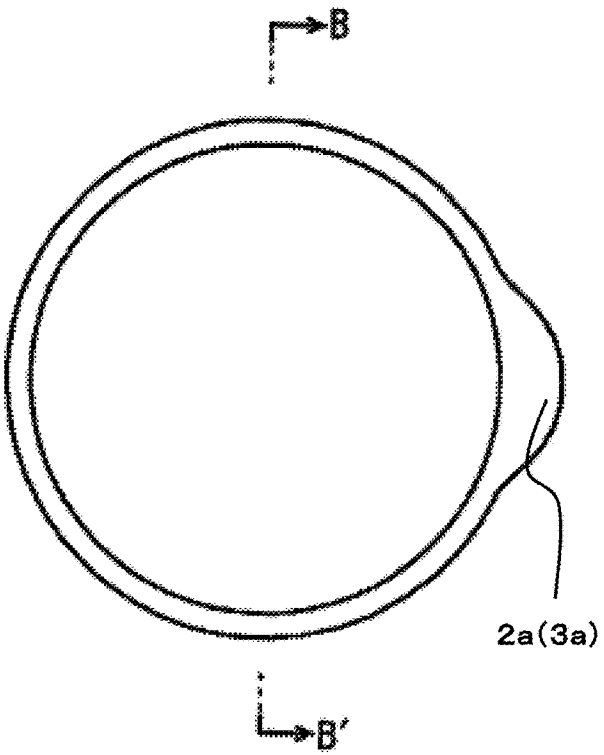
LEFT SIDE VIEW
FIG.2B
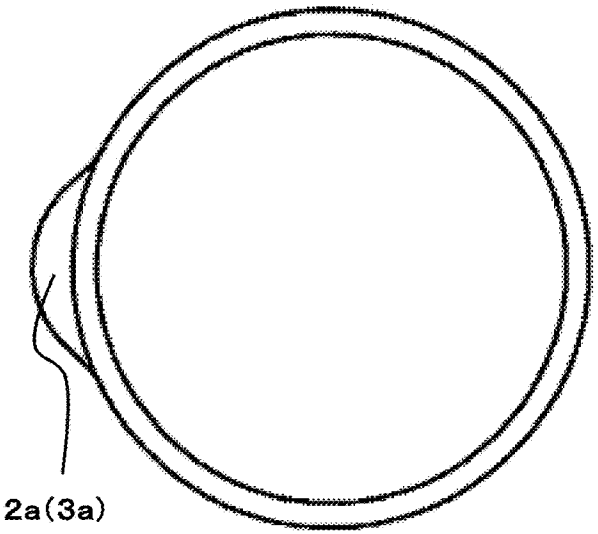
RIGHT SIDE VIEW
FIG.2A

FIG.3
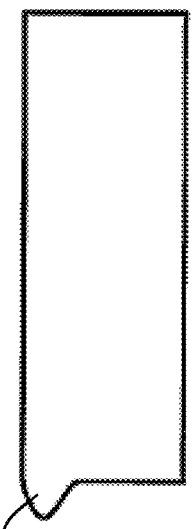
PLAN VIEW
FIG.3A
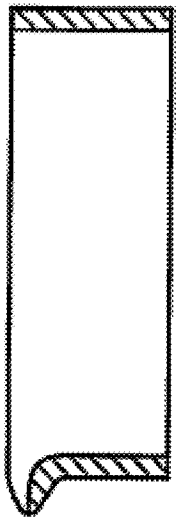
SECTIONAL VIEW TAKEN ALONG SECTIONAL LINE A–A′
FIG.3B
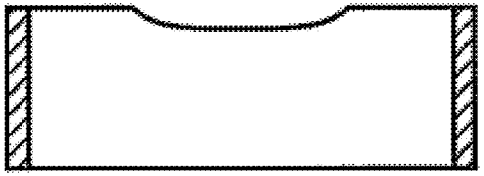
SECTIONAL VIEW TAKEN ALONG SECTIONAL LINE B–B′
FIG.3C

AFTER PATTERN FORMATION STEP (ST19)

AFTER FLATTENING STEP (ST20)

RING MANUFACTURING METHOD, RING MANUFACTURING APPARATUS, AND RING MANUFACTURED BY THE RING MANUFACTURING METHOD

BACKGROUND

The present invention relates to a ring manufacturing method of manufacturing a single ring into a plurality of rings, a ring manufacturing apparatus, and rings manufactured by the ring manufacturing method.

Mokume-gane (wood-grain metal) is a Japanese special world-class metalworking technique. Special processing steps of the mokume-gane technique cannot be simply categorized as a technique, and reach even realms of ideology and mind, that is, are carried out through interaction between materials and a craftsperson.

In the mokume-gane technique, first, metal plate members having different colors are laminated in several layers, bonded to each other, and subjected to a twisting process or other processes. Then, surfaces of a laminate of those metal plate members are chiseled or engraved with a drilling tool, and flattened by forging with a hammer. In this way, a wood-grain pattern is formed on those surfaces.

Incidentally, at the time of forming a pair of matching rings by the mokume-gane technique, there is a request for forming common characteristic patterns on the pair of matching rings.

Hitherto, a metal plate that is obtained by executing the twisting process or other processes on the laminate of the plurality of metal plates is cut into two metal plates, and then those metal plates are processed into rings. By this related-art ring manufacturing method using the mokume-gane technique, the common characteristic patterns can be formed on those two rings obtained from the single metal plate.

SUMMARY

Incidentally, products such as the above-mentioned pair of matching rings have been demanded to have a design that further emphasizes the concept of birth (manufacture) from the same single thing.

In view of such circumstances, the present invention has been made to achieve an object of providing a ring manufacturing method and a ring manufacturing apparatus that enable manufacture of rings having a design that further emphasizes a concept of birth (manufacture) from the same single thing, and an object of providing a ring manufactured by the ring manufacturing method.

In order to achieve the above-mentioned objects, according to the present invention, there is provided a ring manufacturing method including:

a first step of slitting a single ring at a predetermined position in an axial direction of the single ring along a circumferential direction of the single ring in a manner that a partial joint portion is left, to thereby form a single piece including a first ring portion and a second ring portion;

a second step of bending the single ring at a predetermined angle in a direction in which the first ring portion and the second ring portion are separated from each other with respect to the partial joint portion;

a third step of measuring a length of the partial joint portion in a direction orthogonal to the axial direction of the single ring after the bending in the second step;

a fourth step of forming a slit in the partial joint portion based on a result of the measuring in the third step such that the length of the partial joint portion in the direction orthogonal to the axial direction of the single ring is equal to a preset value; and a fifth step of cutting the partial joint portion at a predetermined position of the partial joint portion after the fourth step such that the first ring portion and the second ring portion are separated from each other, to thereby obtain a first ring and a second ring.

It is preferred that, in the present invention, the fourth step include forming the slit on one side of the partial joint portion between the first ring portion and the second ring portion, the one side being subjected to the slitting in the first step.

It is preferred that, in the present invention, the fourth step include forming the slit on one side of the partial joint portion between the first ring portion and the second ring portion, the one side being subjected to the slitting in the first step, and forming another slit on another side opposite to the one side.

It is preferred that, in the present invention, the first ring and the second ring each include a peripheral part that is adjacent to the partial joint portion between the first ring portion and the second ring portion, and has a recess having a size corresponding to a volume of the partial joint portion.

According to another present invention, there is provided another ring manufacturing method including:

a first step of slitting a single ring at a predetermined position in an axial direction of the single ring along a circumferential direction of the single ring in a manner that a partial joint portion is left, to thereby form a single piece including a first ring portion and a second ring portion;

a second step of bending the single ring at a predetermined angle in a direction in which the first ring portion and the second ring portion are separated from each other with respect to the partial joint portion; and a third step of cutting the partial joint portion at a predetermined position of the partial joint portion after the bending in the second step such that the first ring portion and the second ring portion are separated from each other, to thereby obtain a first ring and a second ring.

According to still another present invention, there is provided a ring manufacturing apparatus including:

first means for slitting a single ring at a predetermined position in an axial direction of the single ring along a circumferential direction of the single ring in a manner that a partial joint portion is left, to thereby form a single piece including a first ring portion and a second ring portion;

second means for bending the single ring at a predetermined angle in a direction in which the first ring portion and the second ring portion are separated from each other with respect to the partial joint portion;

third means for measuring a length of the partial joint portion in a direction orthogonal to the axial direction of the single ring after the bending by the second means;

fourth means for forming a slit in the partial joint portion based on a result of the measuring by the third means such that the length of the partial joint portion in the direction orthogonal to the axial direction of the single ring is equal to a preset value; and fifth means for cutting the partial joint portion at a predetermined position of the partial joint portion after the forming of the slit by the fourth means such that the first ring portion and the second ring portion are separated from each other, to thereby obtain a first ring and a second ring.

According to yet another present invention, there is provided a ring, which includes a first ring and a second ring, the ring being manufactured by:

a first step of slitting a single ring at a predetermined position in an axial direction of the single ring along a circumferential direction of the single ring in a manner that a partial joint portion is left, to thereby form a single piece including a first ring portion and a second ring portion;

a second step of bending the single ring at a predetermined angle in a direction in which the first ring portion and the second ring portion are separated from each other with respect to the partial joint portion;

a third step of measuring a length of the partial joint portion in a direction orthogonal to the axial direction of the single ring after the bending in the second step;

a fourth step of forming a slit in the partial joint portion based on a result of the measuring in the third step such that the length of the partial joint portion in the direction orthogonal to the axial direction of the single ring is equal to a preset value; and a fifth step of cutting the partial joint portion at a predetermined position of the partial joint portion after the fourth step such that the first ring portion and the second ring portion are separated from each other, to thereby obtain the first ring and the second ring.

According to the present invention, it is possible to provide a ring manufacturing method and a ring manufacturing apparatus that enable manufacture of rings having a design that further emphasizes a concept of birth (manufacture) from the same single thing, and to provide a ring manufactured by the ring manufacturing method.

BRIEF DESCRIPTION OF DRAWINGS

FIG. 1A is a front view of a male ring and a female ring manufactured by a ring manufacturing method according to an embodiment of the present invention;

FIG. 1B is a rear view of the male ring and the female ring illustrated in FIG. 1A;

FIG. 2A is a right side view of the male ring and the female ring illustrated in FIG. 1;

FIG. 2B is a left side view of the male ring and the female ring illustrated in FIG. 1;

FIG. 3A is a plan view of the male ring and the female ring illustrated in FIG. 1;

FIG. 3B is a sectional view taken along the sectional line A-A' in FIG. 1A;

FIG. 3C is a sectional view taken along the sectional line B-B' in FIG. 2B;

DETAILED DESCRIPTION OF EMBODIMENTS

Now, an embodiment of the present invention is described with reference to the drawings.

In this embodiment, description is made of a case of manufacturing a male ring (example of a first ring according to the embodiment of the present invention) and a female ring (example of a second ring according to the embodiment of the present invention) by a mokume-gane technique.

FIG. 1A is a front view of a male ring 2 and a female ring 3 manufactured by a ring manufacturing method according to this embodiment, and FIG. 1B is a rear view of the male ring 2 and the female ring 3 illustrated in FIG. 1A.

FIG. 2A is a right side view of the male ring 2 and the female ring 3 illustrated in FIG. 1, and FIG. 2B is a left side view of the male ring 2 and the female ring 3 illustrated in FIG. 1.

FIG. 3A is a plan view of the male ring 2 and the female ring 3 illustrated in FIG. 1, FIG. 3B is a sectional view taken along the sectional line A-A' in FIG. 1A, and FIG. 3C is a sectional view taken along the sectional line B-B' in FIG. 2B.

FIG. 4A, FIG. 4B, FIG. 4C, FIG. 4D, and FIG. 4E are explanatory views illustrating steps of manufacturing a single ring 21 into the male ring 2 and the female ring 3.

Figure 4:
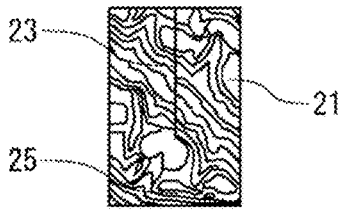
FIG. 4A is an explanatory view illustrating a step of manufacturing a single ring into the male ring and the female ring.
FIG. 4B is an explanatory view illustrating a step of manufacturing a single ring into the male ring and the female ring.
FIG. 4C is an explanatory view illustrating a step of manufacturing a single ring into the male ring and the female ring.
FIG. 4D is an explanatory view illustrating a step of manufacturing a single ring into the male ring and the female ring.
FIG. 4E is an explanatory view illustrating a step of manufacturing a single ring into the male ring and the female ring.
Figure 4:
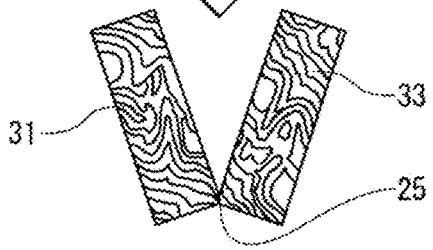
Figure 4:
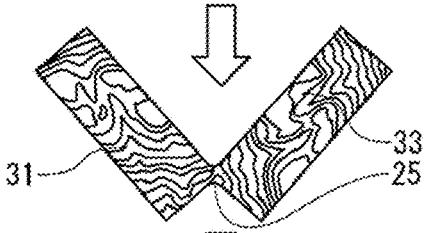
Figure 4:
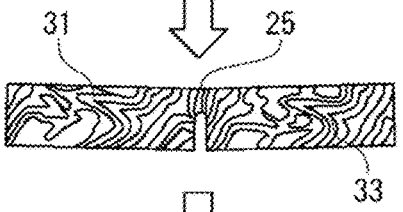
Figure 4:
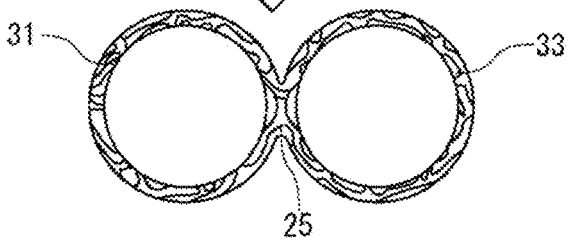

As illustrated in FIG. 4A, the single ring 21 is slit at a predetermined position in an axial direction of the single ring 21 along a circumferential direction of the single ring 21, specifically, slit along a line 23 in a manner that a partial joint portion 25 is left. With this, a male ring portion 31 and a female ring portion 33 are formed.

Then, as illustrated in FIG. 4B, FIG. 4C, FIG. 4D, and FIG. 4E, the single ring 21 is bent at a predetermined angle (approximately 90°) in a direction in which the male ring portion 31 and the female ring portion 33 are separated from each other with respect to the joint portion 25.

Next, the joint portion 25 is cut. With this, the male ring 2 and the female ring 3 illustrated in FIG. 1 are obtained.

As illustrated in FIG. 1A, on the male ring 2 side, a projection portion 2*a* is formed of the joint portion 25 in a manner of protruding from an outer peripheral surface of the male ring 2. On the female ring 3 side, a projection portion 3*a* is formed of the joint portion 25 in a manner of protruding from an outer peripheral surface of the female ring 3. In this case, the projection portion 2*a* and the projection portion 3*a* are formed as a result of cutting the joint portion 25. With this, a concept of birth (manufacture) from the same single thing can be expressed by external appearances of the male ring 2 and the female ring 3.

Figure 5:
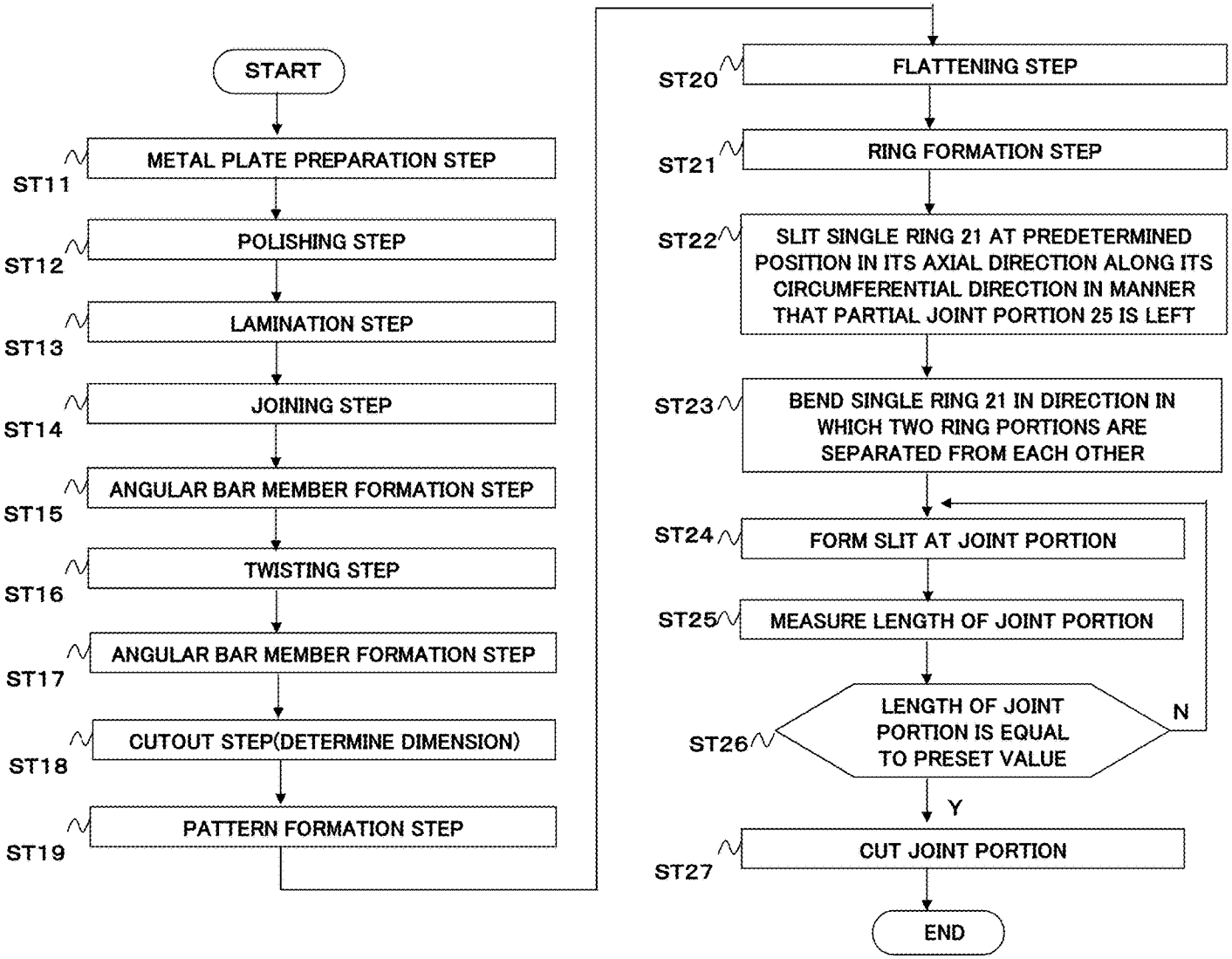
FIG. 5 is a flowchart showing a procedure of a ring manufacturing method according to the embodiment of the present invention.

FIG. 5 is a flowchart showing a procedure of a ring manufacturing method according to the embodiment of the present invention.

Some or all of the following steps are performed by machine (ring manufacturing apparatus) or by hand.

[Metal Plate Preparation Step (Step ST11)]

A plurality of metal plates made of different materials are prepared.

In this embodiment, fifteen metal plates are prepared.

Examples of the materials of the metal plates include platinum (Pt), gold (Au), silver (Ag), copper (Cu), brass, titanium (Ti), iron (Fe), nickel (Ni), stainless steel, tantalum (Ta), and mixtures thereof.

The metal plates made of the different materials are different from each other also in visually recognizable characteristics such as a degree of color or gloss. The metal plates each have a thickness of from approximately 0.1 mm to approximately 1.0 mm. Note that, there are no problems as long as metal plates made of at least two different materials are prepared. Further, two or more of the plurality of metal plates may be of the same type.

[Polishing Step (Step ST12)]

Next, pretreatment for joining is performed. Specifically, the plurality of metal plates are polished with sandpaper sheets having grit sizes of, for example, #600, #800, #1,000, #1,200, and #1,500. Then, when necessary, surfaces of those metal plates are uniformly and elaborately finished with a charcoal block.

[Lamination Step (Step ST13)]

Next, the plurality of metal plates are laminated and joined to each other. With this, a multi-layered metal body formed of a laminate of the plurality of metal plates (example of the plurality of laminated metal plates according to the embodiment of the present invention) is obtained.

Note that, an order of lamination is determined in consideration of a final design (characteristic pattern).

In this case, the thickness of each of the metal plate ranges, for example, from 0.05 mm to 0.2 mm, and the multi-layered metal body measures, for example, (1.0 mm to 2.0 mm)×(40 mm to 60 mm)×(60 mm to 80 mm).

[Joining Step (Step ST14)]

The metal plates are joined to each other by performing, for example, diffusion bonding under a state in which the metal plates are held in close contact with each other, the diffusion bonding including utilizing atomic diffusion that is caused between bonding surfaces of the metal plates by pressurizing the metal plates at temperature equal to or less than melting points of the metal plates to an extent that plastic deformation of the metal plates is prevented as much as possible.

At the time of performing the diffusion bonding, the metal plates are heated, for example, to from 500° C. to 1,200° C., and pressurized, for example, to from 200 kgf/cm$^2$ to 500 kgf/cm$^2$. Note that, the metal plates may be joined to each other by brazing and soldering.

[Angular Bar Member Formation Step (Step ST15)]

Next, minute parts are inspected, and incompletely laminated parts are removed. Then, as illustrated in FIG. 9A, the multi-layered metal body is formed into an angular bar member by flattening with a roller, for example.

[Twisting Step (Step ST16)]

Figure 9:
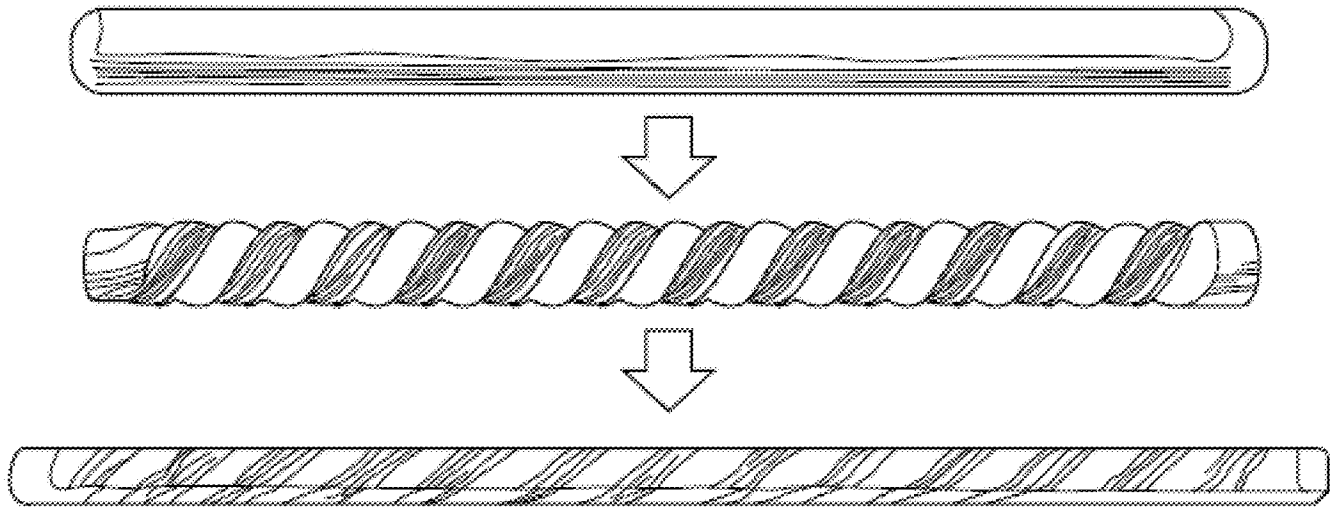
FIG. 9A is an explanatory view illustrating Step ST15 shown in FIG. 5.
FIG. 9B is an explanatory view illustrating Step ST16 shown in FIG. 5.
FIG. 9C is an explanatory view illustrating Step ST17 shown in FIG. 5.

Next, as illustrated in FIG. 9B, the angular bar member is twisted several times alternately in a direction orthogonal to a longitudinal direction of the angular bar member.

This twisting process is carefully executed little by little while repeating heating and annealing in consideration of the lamination order such that the angular bar member formed by the diffusion bonding is twisted several times as described above without being broken. Specifically, a heating-and-twisting step, a cooling step, and an annealing step are repeated in this order.

[Angular Bar Member Formation Step (Step ST17)]

Next, as illustrated in FIG. 9C, the angular bar member subjected to the twisting step is reshaped into the angular bar shape by the flattening with the roller.

In this embodiment, a size of a cross-section of the multi-layered metal body at this time point is reduced to be smaller than that after Step ST15. With this, adjustment to final finished dimensions is facilitated.

Further, when the multi-layered metal body is processed into the angular bar shape prior to formation of a pattern, pattern formation targets can be formed to be flat. With this, the pattern can be easily formed.

[Cutout Step (Step ST18)]

Next, the angular bar member obtained in Step ST17 is cut out by an amount necessary for forming rings or pendants.

[Pattern Formation Step (Step ST19)]

Figure 10:
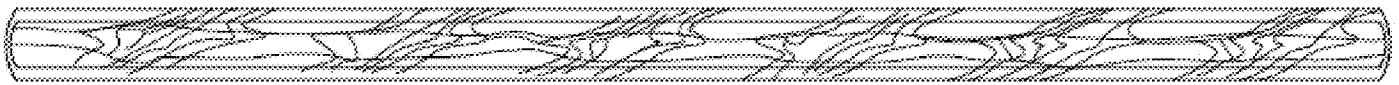
FIG. 10 is an explanatory view illustrating Step ST19 shown in FIG. 5.

Next, as illustrated in FIG. 10, a predetermined pattern such as letters, symbols, and graphics is formed on surface sides of the angular bar member.

The pattern is formed by chiseling or engraving with a drilling tool.

Specifically, after the twisting process, the chiseling or the engraving with the drilling tool is performed to a depth half or more of the thickness of the laminate.

When the thick laminate is engraved to such a depth, at the time of being flattened with the roller, the surface of the laminate is excessively uneven. This excessive unevenness has a significant influence on an overall outer shape and a pattern formed by the twisting process. Actually, the engraving is not finished at once. Instead, after the angular bar member subjected to the twisting process is processed into a flat plate shape to some extent, a step of engraving and flattening the angular bar member having the flat plate shape is repeated ten and several times. In this way, the pattern is formed.

In this embodiment, the angular bar member subjected to the twisting process is flattened with the roller until its thickness is reduced to approximately half or less.

[Flattening Step (Step ST20)]

Figure 11:
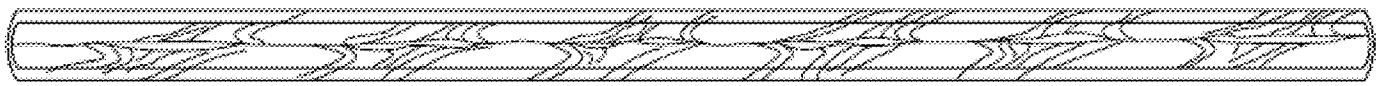
FIG. 11 is an explanatory view illustrating Step ST20 shown in FIG. 5.

Next, as illustrated in FIG. 11, the angular bar member having the pattern formed in Step ST19 is flattened in a longitudinal direction of the angular bar member so as to be formed into a metal plate having a predetermined thickness.

Specifically, the angular bar member is inserted between two rollers set rollable at a predetermined interval such that the surfaces of the angular bar member are pressurized. In this way, the angular bar member is flattened.

[Ring Formation Step (Step ST21)]

After that, the metal plate obtained by the flattening in Step ST20 is processed into a ring shape. With this, the ring 21 is obtained.

[Ring Slitting Step (Step ST22)]

As illustrated in FIG. 4A, the single ring 21 is slit at the predetermined position in the axial direction of the single ring 21 (specifically, at a position near a center of the single ring 21) along the circumferential direction of the single ring 21, specifically, slit along the line 23 in a manner that the partial joint portion 25 is left. With this, the male ring portion 31 and the female ring portion 33 are formed.

At this time, in order to set a width of the male ring portion 31 in the axial direction of the single ring 21 larger than a width of the female ring portion 33 in the axial direction of the single ring 21, in accordance with a ratio of those widths, the ring 21 is slit at a position out of the center in the axial direction of the single ring 21.

Further, a size of the joint portion 25 is determined in accordance with desired sizes of the projection portions 2*a* and 3*a* illustrated in FIG. 1

[Bending Step (Step ST23)]

Then, as illustrated in FIG. 4B, FIG. 4C, FIG. 4D, and FIG. 4E, the single ring 21 is bent at the predetermined angle (for example, approximately 90°) in the direction in which the male ring portion 31 and the female ring portion 33 are separated from each other with respect to the joint portion 25. Note that, the predetermined angle is not limited to 90°.

[Step of Forming Slit at Joint Portion (Step ST24)]

In accordance with requests from clients, a "mark left" type in which sizes of the projection portions 2*a* and 3*a*, that is, residual marks to be obtained from the joint portion 25 are relatively large, or a "mark removed" type in which the sizes of those residual marks are relatively small is selected.

Figure 6:
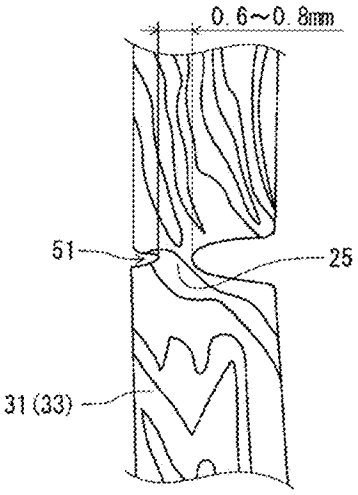
FIG. 6A is an explanatory view illustrating a slit forming method in a case of a "mark left type;"
FIG. 6B is an explanatory view illustrating a slit forming method in a case of a "mark removed type;"
Figure 6B:
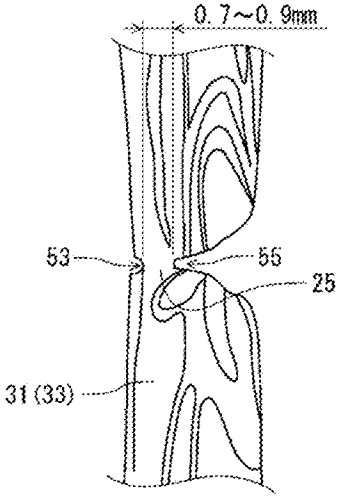

FIG. 6A is an explanatory view illustrating a slit forming method in a case of the "mark left" type, and FIG. 6B is an explanatory view illustrating a slit forming method in a case of the "mark removed" type.

As illustrated in FIG. 6A, in the case of the "mark left" type, a slit 51 is formed on the line 23 side (slit side) of the joint portion 25. The slit 51 is formed, for example, with a scroll saw. By the formation of the slit 51, a length of the joint portion 25 in a direction orthogonal to the axial direction of the single ring 21 is set to from approximately 0.6 mm to approximately 0.8 mm.

As illustrated in FIG. 6B, in the case of the "mark removed" type, a slit 53 and a slit 55 are formed respectively on the line 23 side (slit side) and a side opposite thereto of the joint portion 25. Those slits 53 and 55 are formed, for example, with the scroll saw. By the formation of those slits 53 and 55, the length of the joint portion 25 in the direction orthogonal to the axial direction of the single ring 21 is set to from approximately 0.7 mm to approximately 0.9 mm.

[Measurement of Length of Joint Portion (Step ST25 and Step ST26)]

Figure 7:
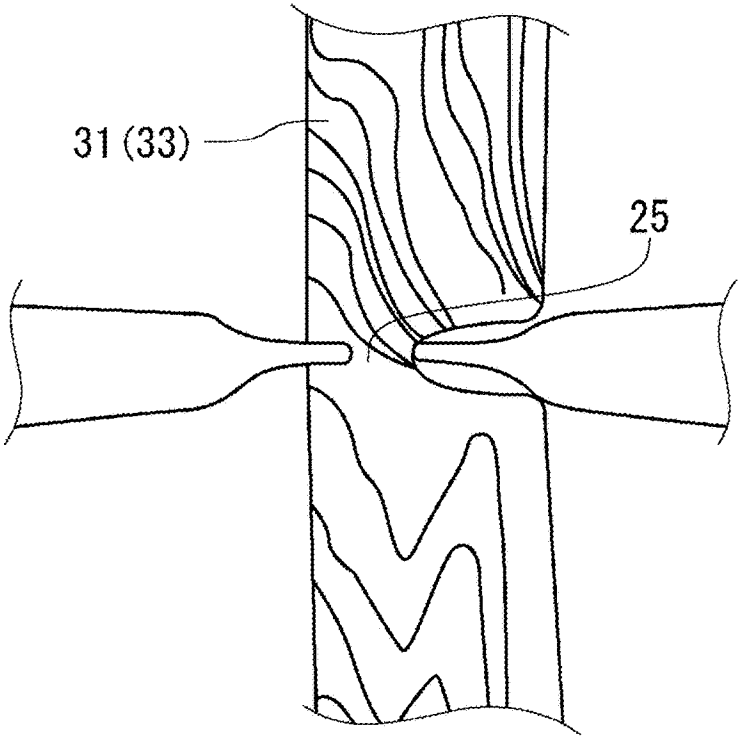
FIG. 7 is an explanatory view illustrating a method of measuring a length of a joint portion.

As illustrated in FIG. 7, the length of the joint portion 25 after the slit formation is measured with a measuring instrument.

Note that, as illustrated in FIG. 7, distal ends of probes of a measuring instrument are inserted to depths in the slits. With this, measurement accuracy can be enhanced.

When a measurement result that the length of the joint portion 25 is equal to a preset value is obtained, the procedure proceeds to Step ST27, and otherwise returns to Step ST24 (Step ST26).

[Cutting Step (Step ST27)]

After that, the joint portion 25 is cut. With this, the male ring 2 and the female ring 3 illustrated in FIG. 1 are obtained.

At this time, the joint portion 25 is cut at a center of the joint portion 25, specifically, a center between the projection portions forming the joint portion 25.

With this, as illustrated in FIG. 1A, on the male ring 2 side, the projection portion 2*a* is formed of the joint portion 25 in a manner of protruding from the outer peripheral surface of the male ring 2. On the female ring 3 side, the projection portion 3*a* is formed of the joint portion 25 in a manner of protruding from an outer peripheral surface of the female ring 3.

Figure 8:
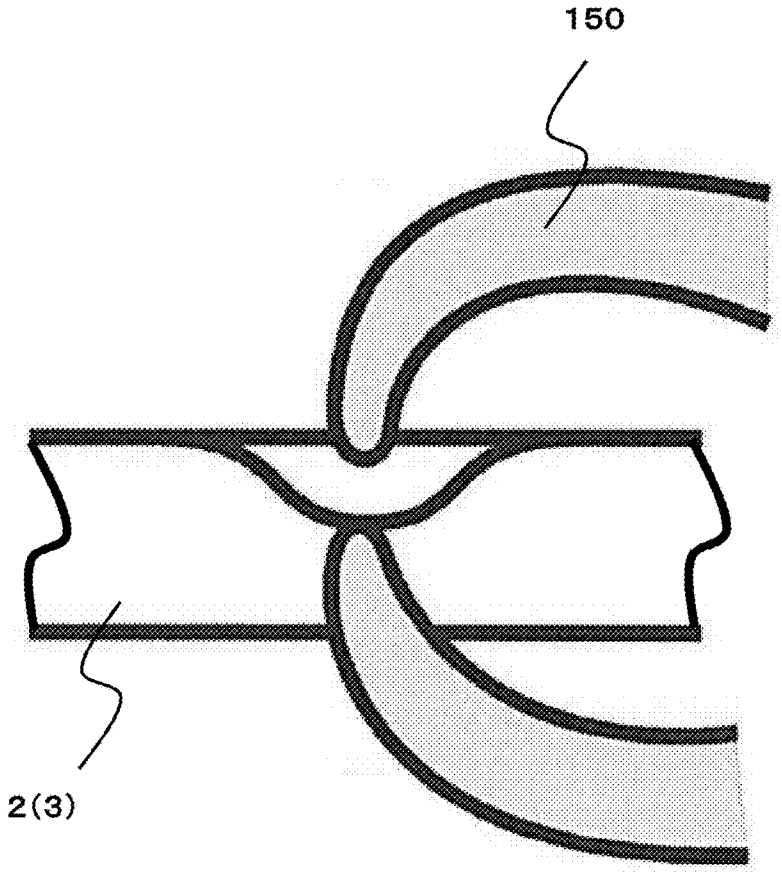
FIG. 8 is an explanatory view illustrating a method of measuring a center of the mark.

Note that, after the cutting, with use of a measuring instrument 150 as illustrated in FIG. 8, a shape of the mark of each of the projection portions 2*a* of the male ring 2 and the projection portion 3*a* of the female ring 3 is measured. When necessary, the marks are processed.

In this case, the projection portion 2*a* and the projection portion 3*a* are formed as a result of cutting the joint portion 25. With this, the concept of birth (manufacture) from the same single thing can be expressed by the external appearances of the male ring 2 and the female ring 3.

On the peripheral surface of the male ring 2 and the female ring 3, at parts that are adjacent respectively to the projection portion 2*a* and the projection portion 3*a*, recesses each having a size corresponding to a volume of corresponding one of the projection portions 2*a* and 3*a* are respectively formed.

As described above, according to this embodiment, the male ring 2 and the female ring 3 are manufactured by the procedure described above. With this, the male ring 2 and the female ring 3 can have a design that further emphasizes the concept of birth (manufacture) from the same single thing.

Further, in this embodiment, as shown in Step ST23, Step ST24, and Step ST25 in FIG. 5 and as illustrated in FIG. 6 and FIG. 7, after the bending step (Step ST23), the slit 51 and the slits 53 and 55 are formed in accordance respectively with the request for the "mark left" type and the request for the "mark removed" type, and then the cutting step is carried out (Step ST26). Thus, the marks of the projection portion 2*a* of the male ring 2 and the projection portion 3*a* of the female ring 3 can each be reliably formed into a desired shape.

In addition, in the cutting step, the joint portion 25 can be effectively prevented from being cut into an inappropriate shape, and hence a higher yield can be achieved.

The present invention is not limited to the above-described embodiment.

Specifically, those skilled in the art may make various modifications, combinations, sub-combinations, and alterations of the components of the above-described embodiment within the technical scope of the present invention or the equivalents thereof.

More specifically, the present invention is applicable also to a metal pair manufacturing apparatus configured to carry out the above-described steps with specific hardware (means).

In the case exemplified in the above-described embodiment, two rings are formed of a single metal body. However, the present invention is applicable also to a case of forming the single metal body into a plurality of other accessories.

Examples of those accessories include rings, pendants, necklaces, earrings, cuff links, brooches, tie tacks, bangles, buckles, chokers, and bracelets.

Further, the present invention is applicable not only to those accessories, but also, for example, to knives, swords, spoons, jewelry boxes made of precious metals, vases and basins made of precious metals, compacts, watches, and smokers' articles.

Still further, the number, the thickness, and other parameters of the metal plates may be arbitrarily set.

INDUSTRIAL APPLICABILITY

The present invention is applicable to a case of processing a metal body into rings.

What is claimed is:

1. A ring manufacturing method, comprising:

a step of slitting a single ring at a predetermined position in an axial direction of the single ring along a circumferential direction of the single ring in a manner that a partial joint portion is left, to thereby form a single piece including a first ring portion and a second ring portion;

a step of bending the single ring at a predetermined angle in a direction in which the first ring portion and the second ring portion are separated from each other with respect to the partial joint portion;

a step of measuring a length of the partial joint portion in a direction orthogonal to the axial direction of the single ring after the bending in the second step;

a step of forming a slit in the partial joint portion based on a result of the measuring in the third step such that the length of the partial joint portion in the direction orthogonal to the axial direction of the single ring is equal to a preset value; and a step of cutting the partial joint portion at a predetermined position of the partial joint portion after the fourth step such that the first ring portion and the second ring portion are separated from each other, to thereby obtain a first ring and a second ring.

2. The ring manufacturing method according to claim 1, wherein in the step of forming the slit on one side of the partial joint portion between the first ring portion and the second ring portion, the one side being subjected to the slitting in the first step.

3. The ring manufacturing method according to claim 1, wherein the step of forming the slit on one side of the partial joint portion between the first ring portion and the second ring portion comprises:

forming the slit on one side of the partial joint portion between the first ring portion and the second ring portion, the one side being subjected to the slitting in the first step, and forming another slit on another side opposite to the one side.

4. The ring manufacturing method according to claim 1, wherein the first ring and the second ring each comprise a peripheral part that is adjacent to the partial joint portion between the first ring portion and the second ring portion, and has a recess having a size corresponding to a volume of the partial joint portion.

5. A ring manufacturing method, comprising:

a step of slitting a single ring at a predetermined position in an axial direction of the single ring along a circumferential direction of the single ring in a manner that a partial joint portion is left, to thereby form a single piece including a first ring portion and a second ring portion;

a step of bending the single ring at a predetermined angle in a direction in which the first ring portion and the second ring portion are separated from each other with respect to the partial joint portion; and a step of cutting the partial joint portion at a predetermined position of the partial joint portion after the bending in the second step such that the first ring portion and the second ring portion are separated from each other, to thereby obtain a first ring and a second ring.

* * * * *